United States Patent [19]

Bodner et al.

[11] 4,423,523

[45] Jan. 3, 1984

[54] OVERLAPPING BIBS ON STRIP

[76] Inventors: Beverly B. Bodner, 5914 Carell Ave., Agoura, Calif. 91301; Bonnie J. Liebmann, 290 Mountain Home Rd., Woodside, Calif. 94062

[21] Appl. No.: 404,516

[22] Filed: Jul. 30, 1982

Related U.S. Application Data

[63] Continuation of Ser. No. 300,520, Sep. 21, 1981, abandoned.

[51] Int. Cl.[3] ..... A41D 27/12

[52] U.S. Cl. ..... 2/49 R; 2/48

[58] Field of Search ..... 2/48–52

[56] References Cited

U.S. PATENT DOCUMENTS 2,424,680 7/1947 Doyle ..... 2/49 R 3,583,558 6/1971 Davis ..... 2/49 R 4,306,316 12/1981 Klepfer ..... 2/48

*Primary Examiner*—Doris L. Troutman

*Attorney, Agent, or Firm*—Kenneth E. Merklen; David Pressman

[57] ABSTRACT

Temporary disposable apparel, such as a bib is formed in a multilayer arrangement with at least one absorbent panel and a non-absorbent panel. The absorbent panel forms the front and the non-absorbent panel forms the back with the non-absorbent panel offset downward or longitudinally terminating in a free flap. A series or strip of such bibs are tear line connected and may be packaged in a roll. The offset feature of the two panels provides for protection of an adhesive strip on the upper inside of the absorbent panel by the free flap of the adjacent bib in the strip. Tear lines between connecting or adjacent bibs in the strip provide for convenient packaging.

19 Claims, 7 Drawing Figures

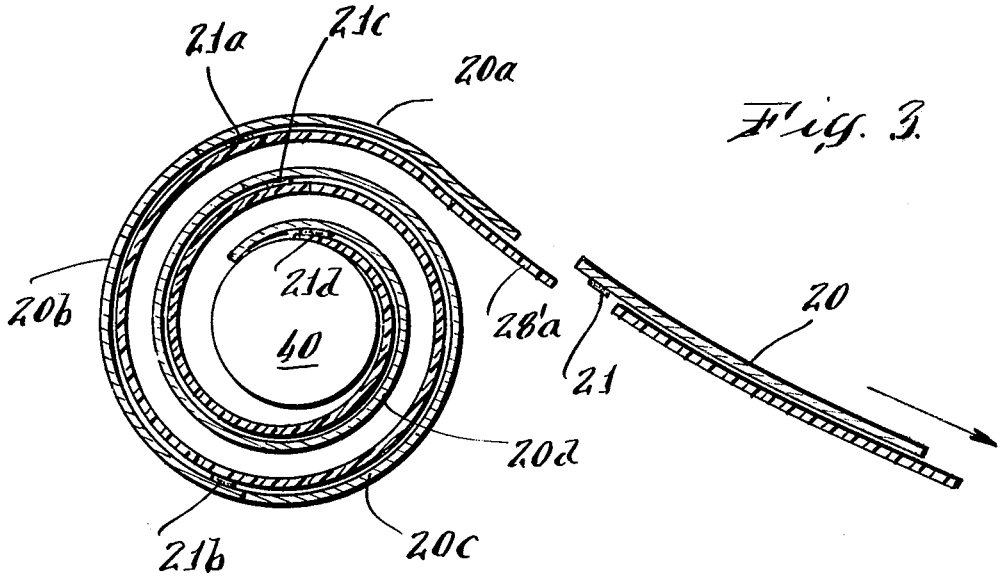
Fig. 3.
Fig. 3A.
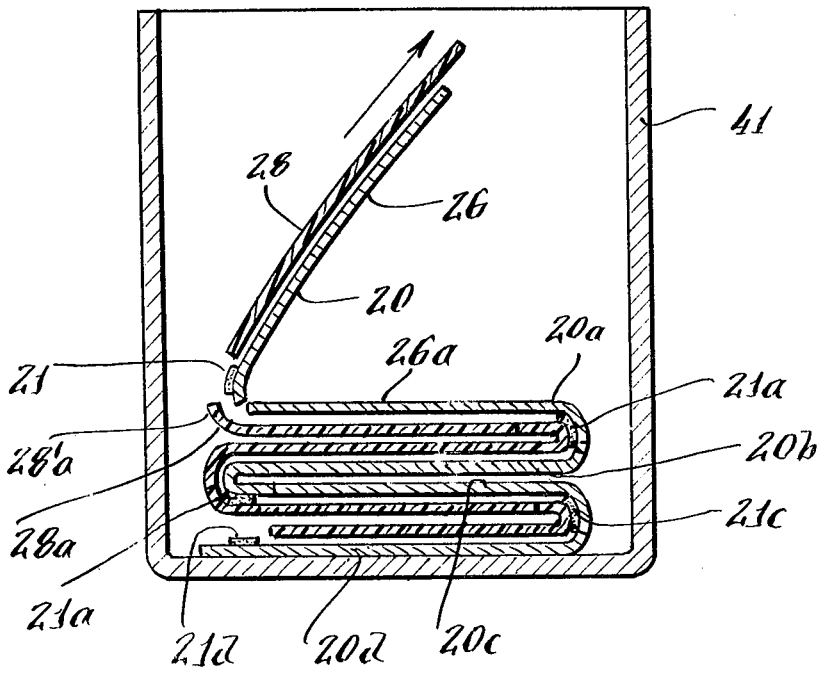

OVERLAPPING BIBS ON STRIP

This is a continuation of application Ser. No. 06/300,520 filed Sept. 21, 1981 now abandoned.

The present invention relates to temporary apparel such as bibs or aprons which are placed over part of the clothing to avoid or prevent soiling the clothing. Bibs are mostly associated with infants and are used during the feeding and often while the child is teething to keep the clothing of the child clean and dry. However, there are other uses for bibs such as adult use on special occasions and Dentists often use bibs on patients. The present invention, although not limited to bibs will be described in relation to bibs, but it will be understood the scope of the invention covers a variety of temporary apparel.

PRIOR ART

It is well known to provide a bib for an infant while feeding the child to prevent food and/or liquid from falling directly on to the clothing of the child, thus soiling the clothing of the child particularly in the chest-/abdominal region. Bibs are usually made of an absorbent, cloth material generally forming a protection shield over the chest and stomach area and secured to the child by ties attached to the bib and tied loosely around the neck of the child. Bibs are generally washable because of the large amount of spillage caught by the bib during feeding. A cloth bib is usually of a thick absorbent, yet washable material which can sustain many cycles of cleaning. It is not unusual for a parent to use several bibs in a single day because a prior used bib, on the same day may be wet from either spilled liquid fed to the child or be wet from cleaning food dropped on the bib. Thus it may be prudent that the parent keep a supply of bibs on hand for use in the event that several require washing, and subsequent drying due to the bib being in a soiled condition.

The use of reusable, cloth bibs is expensive and entails a large amount of repetitive work by the parent because reusable bibs that have been soiled must be washed and dried before reusing. This is normally a constant cycle which may extend, in some cases until the child is several years of age.

Another use of bibs is found in restaurants which serve sea-food, especially lobster and crab menus. In many establishments a bib, particularly designed for adult use, is provided to protect clothing because of the manner in which the particular food is acceptably eaten. These adult type bibs are normally made of paper and may come in bundles or stacks, such as a ream of paper, i.e. in individual sheets or bibs, as the case may be. Adult type bibs are throw-away bibs. They are usually secured on to the wearer by snapping together two elongated upper portions which extend around the neck, meet at the back of the neck and are snapped together by means of a snap pair located near the end or tip of each extended portion. The basic problem with adult type bibs is that they are not efficient. In some cases this type of bib is more for effect than utility since a normal napkin, which is normally provided while dining may be utilized to protect clothing.

PRESENT INVENTION

The present invention, in the form disclosed, which is the preferred embodiment, is a disposable bib of laminated construction, tear-seam connected to each other and provided in a roll, tear-off form. The individual bibs are of laminated construction with the front portion of the lamination a highly absorbent material and the back portion of the lamination a non-absorbent material which may be non-porous, such as plastic material. The lamination is so constructed that the absorbent portion of the combination is longitudinally offset from the non-absorbent portion so that the upper portion, on the back of the absorbent part is not laminated to a non-absorbent part. Since both the absorbent part and the non-absorbent part of the combination are substantially the same length, the lower part of the non-absorbent part extends beyond the lower edge of the absorbent part and serves two purposes. As to the bib of which the non-absorbent portion is a part, this forms a protective flap which prevents the bleeding of absorbed fluid matter out the bottom edge of the absorbent portion, on to the clothing the bib is designed to protect. As to the adjacent bib, the protective or free flap of the upper bib serves to cover and preserve an adhesive strip which, in its simplest form is a piece of double face or double sided adhesive, is adhered to the back of the upper or exposed part of the absorbed portion of the lower bib. The exposed or double sided adhesive strip is covered by the non-absorbent, free flap of the upper bib so that when the lower bib is tear-released or torn at the tear-strip of the roll of bibs the adhesive strips on the bib, which are used to attach the bib to the shoulder-neck area of the child, are automatically exposed. The use of an adhesive strip to secure a bib to a child is a safety feature of the present invention over the use of ties.

A plurality of similar bibs may be connected end to end by tear lines making a strip of disposable, tear-off bibs which can be packaged in roll form. These safe, more sanitary, readily available, easily secured, disposable bibs would be available for instant use when the structure taught here is implemented.

It is an object of the invention to provide a disposable, safer, more efficient bib in convenient tear-off strips.

Another object is to provide a strip of laminated bibs where the laminated portions are offset longitudinally so that the leak-proof or non-absorbent part of the absorbent-non-absorbent combination completely protects the clothing under the bib and extends beyond the lower end of the bib to prevent bleeding of the captured or absorbed fluids by the lower edge of the absorbent part of the bib.

Still another object is to provide a multi-layer bib, with at least one absorbent layer and at least one non-porous layer in which exposed adhesive strips on the upper portion of the back of the absorbent layer on one of the bibs are covered, protected and preserved by the flap of the non-porous layer extending from the bib adjacent the upper edge of the adjacent bib.

A further object is to provide a strip of tear off bibs, separated from one another by tear lines which may be provided in roll form.

An object is to provide a strip of individual tear off bibs, separable from one another by tear lines.

These and other objects will become obvious when reading further in conjunction with the drawings in which:

FIG. 3 is an illustration of a strip of bibs on a roll;

FIG. 3A is an illustration of a strip of bibs folded in layers;

Figure 1:
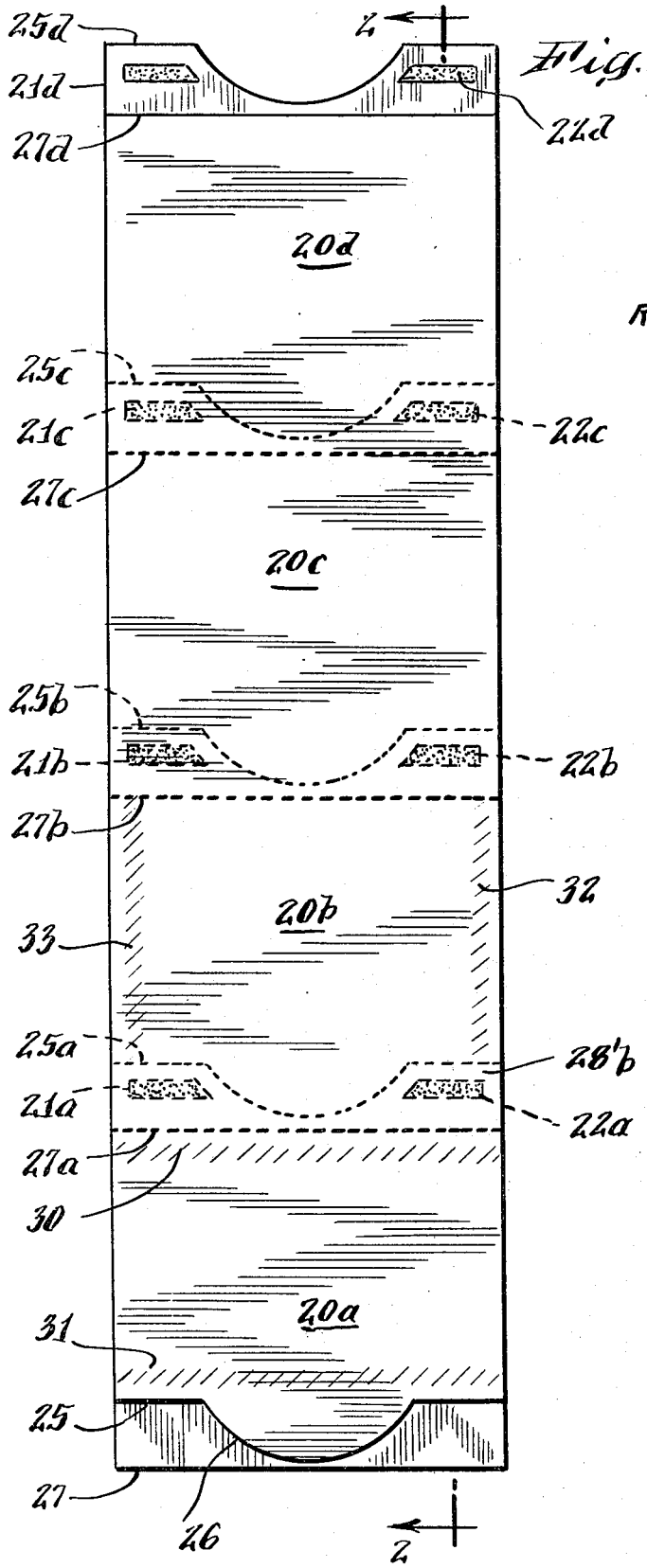
FIG. 1 illustrates a strip of tear connected bibs viewed from the back.
Figure 2:
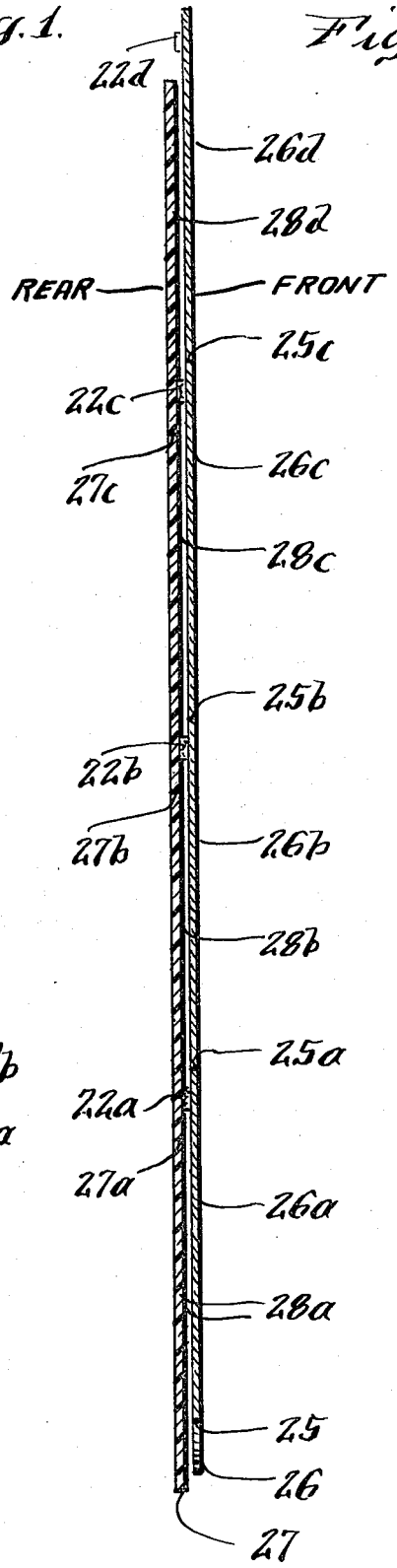
FIG. 2 is a cross-section view along line 2—2 with the layers expanded, for clarity.

Referring now to FIGS. 1 and 2, a strip of tear connected multi-layer disposable bibs is illustrated as 20*a*, 20*b*, 20*c* and 20*d*. Although a tear line between adjacent bibs in a strip is illustrated, a tear strip can be used if desired. The tear line is preferred because a tear strip is wasteful in that it which can be used as part of the bib if a uses throw-away material tear line is used. However, the concept of the invention includes the use of tear strips between adjacent bibs. In the illustration in FIG. 1 it is assumed that the bib below bib 20*a* in the illustration, i.e., connected at tear lines 25 and 27, has been removed since it is anticipated there would be many more than four (4) bibs on a strip of bibs.

For purposes of illustration FIG. 1 shows the back of the strip of bibs and FIG. 2 is a cross section showing, in exploded form, the individual layers of the laminated or multi-layer bib. As seen in FIG. 2, the tear lines 25*a*, 25*b*, 25*c*, when torn, separate the adjacent front panels or layers, which are the absorbent panels or layers of the bib. Tear lines 27*a*, 27*b*, 27*c* when torn, separate the back layers or panels, which are the non-porous, non-absorbent panels or layers of the bib. It is anticipated that the length of each layer of the multi-layer or laminated bib will be substantially the same length, however, it is not necessary that each be identical in length. One may find it convenient to have the non-porous panel 28*a*, for example, slightly longer than the absorbent panel 26*a*, for example (see lines 27 and 25) so as to cover the edge of the absorbent panel at its lower end.

It will also be noted that, for example, on bib 20*a* the non-absorbent, non-porous panel extends to line 27, past the edge of the absorbent panel at line 25. This forms a free flap that 28*a*, for example, that, on adjacent absorbent panels covers, protects, and preserves the adhesive characteristics on the adhesive strip, but yet pulls away without damage to the adhesive characteristics on the part facing the back of the bib so that the bib becomes self adhering to the user. In most cases the adhesive strips would adhere to the clothing of a child, however the adhesive strips could be stuck or adhered to bare skin, without damage to the skin, using presently available adhesives. The adhesive strips 21*a*, 22*b* are adhered, with great strength to the uncovered portion of the absorbent panel 26*a* of bib 20*a*. The free flap or extention of the non-porous, non-absorbent portion 28*b* of bib 20*b* covers and protects adhesive strips 21*a* and 22*a* and characteristically is an easy, non-destructive pull-away when tear line 27*a* is torn to separate panels 28*a* and 28*b*.

The non-absorbent, non-porous panel can be made of rubber, or rubberized material or any one of a number of commercially available plastics. The non-absorbent panel serves as the back of the bib, preventing passage of any materials or matter absorbed by the front, absorbent panel to the clothing beneath the bib. If the material used for the back panel cannot easily be pulled away from the adhesive, the portion covering the adhesive strips could be coated with acrylic or the panel could be made from a flexible, thin sheet of a polymer plastic. Tear lines or tear strips are easily provided in these plastics to effect separation, and exposure of the adhesive surface of the adhesive strips.

The absorbent panel, or panels as discussed relative to FIGS. 4 and 5 below, may be any absorbent material, such as soft fiber paper or any highly absorbent paper or other material. The type of absorbent panel used will depend on the amount and rapidity of absorption desired. Fast and greater quantity absorption characteristics may more readily obtainable in a triple-layer bib as opposed to a two-layer bib, the center absorption layer being one of great and strong absorption characteristics such that the center layer draws fluid matter through the outer layer into itself.

Preferably the layers or panels of the multi-layer bib are secured together at least around the edges or fully laminated. A single multi-layer bib can have its several layers secured to each other using a hot roller process which may be run across the bib, for example at strips 30 and 31 on bib 20*a*. This is seen as a lateral strip lamination. Certainly longitudinal strip lamination may also be used but the roller would have to be adjusted so as not to laminate that portion of the free flap to the absorbent panel. Longitudinal strip lamination is represented by the hatch lines 32 and 33 on bib 20*b*. Also substantially the entire surfaces of the panels may be laminated, i.e. from hatch lines 30 to hatch lines 31 on bib 20*a*.

Referring now to FIGS. 3 and 3A, a strip of tear off bibs is represented, somewhat exploded, wrapped around a roller 40. Roller 40 may be plastic coated in order that the adhesive strip of the interior or last bib be covered and protected so as to preserve its adhesive qualities. It will be seen that the bib 20 in FIG. 3 has been removed from the adjacent bib 20*a* and that the adhesive 21 has been removed from adhesion to the flap 28*a*. As to the bib 20*d* on the roll, it may be desired to use a cover strip over the face of the adhesive strips and prevent adhesion of the strip 21*d* to the roller 40.

Referring to FIG. 3A, a somewhat different packaging is illustrated where the bibs are folded in zig-zag arrangement and packaged in a box or container 41. The bib 20 is shown removed from the packaging and torn away from bib 20*a*. Non-absorbent panel 28 of bib 20 is torn away from non-absorbent panel 28*a* of bib 20*a*, while adhesive strip 21 of bib 20 is pealed away from free flap 28*a*. It will be noted that the adhesive strip 21*d* of bib 20*d* has no protective flap. In this case a cover strip may be used to protect the adhesive characteristics on face of the strip 21*d*.

It will be obvious that the various parts making up the multi-layer or laminated bibs as shown in the various figures have been exploded somewhat to make the descriptions shown more clear. In actual use the various panels or sheets of material making up one complete bib would be or at least have the appearance of an integrated unit, effected by lamination of the multiple sheets or panels or by heat sealing or some other form of sealing.

Figure 4:
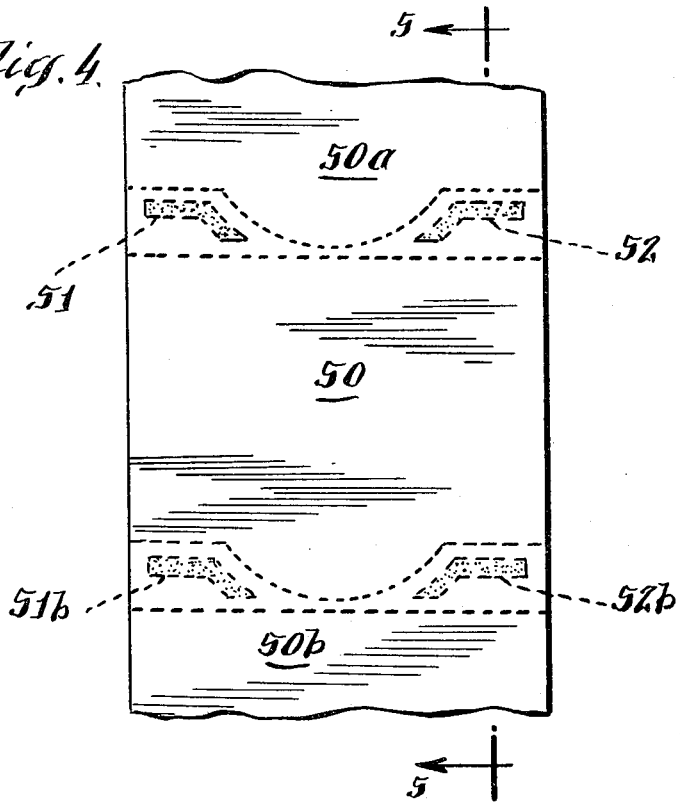
FIG. 4 is another illustration of a strip of bibs showing an alternate adhesive strip structure.
Figure 5:
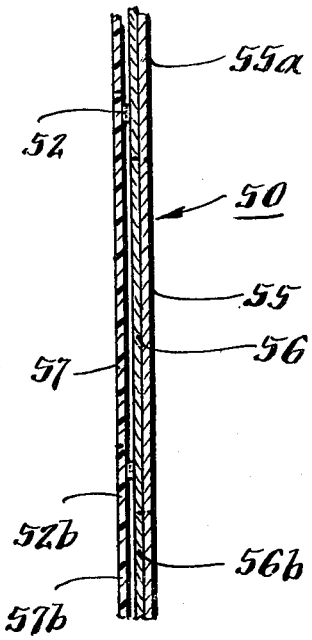
FIG. 5 is a cross section of a triple layer bib.

Referring to FIGS. 4 and 5 a triple layer disposable bib is shown in strip form with a somewhat different shaped adhesive strip. If desired the adhesive strip can be made to extend completely under the chin area 64 shown in FIG. 6. The elongated adhesive strip 63 could be easily protected by extending the free flap of the non-porous, non-absorbent panel, shown as 67 in FIG. 6. The elongation of the non-absorbent panel at the free flap, or bottom then serves a dual purpose. It permits use of a longer, lower placed adhesive strip and prevents against bleeding of the absorbent panel.

Referring again to FIGS. 4 and 5 a dual layer absorbent panel including sheets 55 and 56 are represented on bib 50. The non-porous, non-absorbent panel 57 serves the same purpose as previously discussed with respect to the single layer absorbent panel above.

Figure 6:
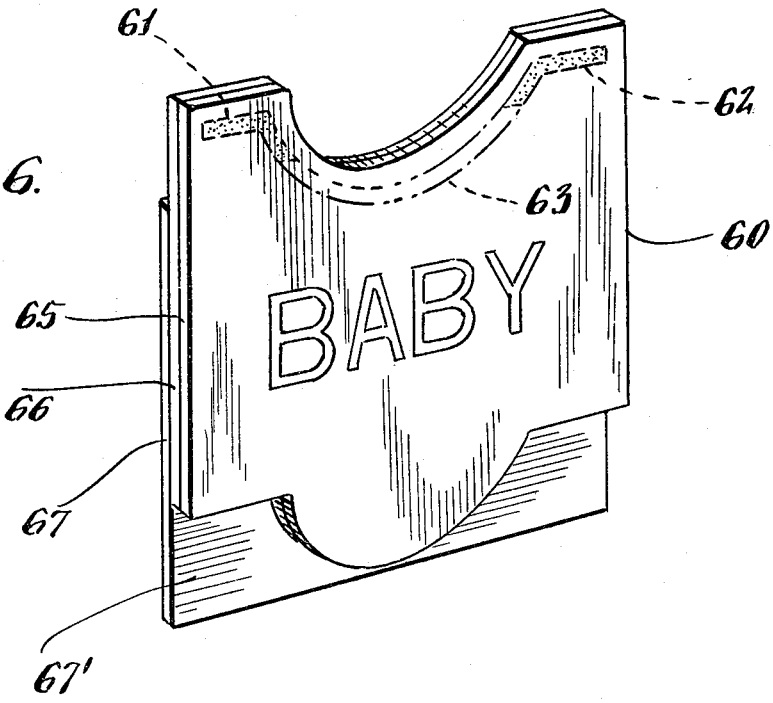
FIG. 6 is a pictorial representation, in front view of single, multi-layer bib.

Bib 60 in FIG. 6 corresponds to the dual layer absorbent bibs shown in FIGS. 4 and 5.

The invention has been described in alternative forms and several different materials, all of which are readily available, have been suggested for use in practicing the invention. Certainly practice of the invention may include making the units herein referred to as bibs, longer so as to form an apron, for example. Changes and modifications of the invention may be made, as will be obvious to one skilled in the art, within the spirit of the invention as defined in the claims.

What is claimed is:

1. Apparel for covering at least part of the clothing on a person for keeping said clothing clean, said apparel comprising:

a first panel having absorbent characteristics, a second panel having non-absorbent characteristics, said first panel and said second panel being substantially the same size, said first panel and said second panel combined at least in part for forming a unitary article, said first panel and said second panel offset from each other so that the upper part of said first panel is free from said second panel and the lower part of said second panel, is free from said first panel, means coupled to said upper part of said first panel said means having adhesive characteristics on its face for securing said apparel to said person's clothing.

2. Apparel for covering at least part of the clothing on a person as in claim 1 and in which said first panel and said second panel are, at least in part, laminated together.

3. Apparel for covering at least part of the clothing on a person as in claim 1 and in which said lower part of said second panel extends beyond the lower edge of said first panel.

4. Apparel for covering at least part of the clothing on a person as in claim 1 and in which said apparel is a bib.

5. Apparel for covering at least part of the clothing on a person as in claim 1 and in which said apparel is an apron.

6. Apparel for covering at least part of the clothing worn by a person for protecting said clothing, said apparel being a multi-layer article at least part of which is combined in laminated form, said apparel comprising an outer layer having absorbent characteristics with respect to liquid matter, an inner layer having non-absorbent and non-porous characteristics with respect to said liquid matter, said outer layer having an upper part free from said inner layer, said inner layer having a lower part free from said outer layer and, means coupled to the inner side of said upper part of said outer layer, said means having an adhesive face for securing said apparel to said clothing.

7. Apparel for covering at least part of the clothing worn by a person as in claim 6 and in which said lower part of said inner layer extends below the lower edge of said outer layer for preventing bleeding of liquid matter absorbed by said outer layer on to said clothing.

8. Apparel for covering at least part of the clothing worn by a person for keeping said clothing clean as in claim 7 and in which said apparel is a bib.

9. Apparel for covering at least part of the clothing worn by a person for protecting said clothing, said apparel comprising:

at least an outer panel of material having absorbent characteristics;

at least an inner panel of material having non-absorbent characteristics;

said outer panel and said inner panel having substantially the same width;

said outer panel and said inner panel having substantially the same length;

said outer panel and said inner panel aligned widthwise and coupled by the surfaces facing each other forming at least a partial lamination of said panels, at least a part of the upper length of said outer panel extending beyond the upper edge of said inner panel for forming an upper free flap of said outer panel, at least a part of the lower length of said inner panel extending beyond the lower edge of said outer panel for forming a lower free flap of said inner panel and adhesive means coupled to the inside surface of said outer panel on said upper free flap and having an exposed adhesive surface means adhesive for securing said apparel to said clothing.

10. A strip of multi-layer bibs, each bib in said strip secured to the adjacent bib in said strip by tear lines extending across the width of said strip, each bib in said strip including:

at least an outer layer of material having absorbent characteristics and an inner of material having substantially less absorbent characteristics than said outer layer;

the length of said bib defined by upper tear line on the outer layer and the lower tear line on the inner layer of the same bib.

11. A strip of multi-layer bibs as in claim 10 and in which said outer layer and said inner layer of the same bib are offset from each other longitudinally.

12. A strip of multi-layer bibs as in claim 11 and in which the longitudinal offset of said outer layer and said inner layer form a free flap of said outer layer at the upper part of the bib and a free flap of said inner layer at the bottom part of said bib.

13. A strip of multi-layer bibs as in claim 12, and in which said free flap of said outer layer of one bib covers the free flap of said inner layer of the bib above said one bib in said strip.

14. A strip of multi-layer bibs as in claim 13 and in which each strip in said strip of multi-layer bibs includes an adhesive strip located on said free flap of said outer layer and said adhesive strip is covered by the free flap of said inner layer of the adjacent bib in said strip.

15. A strip of multi-layer bibs each bib in said strip secured to the adjacent bib in said strip by tear lines extending across the width of said strip, each bib in said strip including:

at least an outer layer of material having absorbent characteristics and an inner layer of material having substantially less absorbent characteristics than said outer layer;

the length of said outer layer and said inner layer of the same bib defined by tear lines extending across the width of said bib;

said outer layer and said inner layer of the same bib in said strip of bibs offset longitudinally for forming a free flap of said outer layer at the upper part of said bib and a free flap of said inner layer at the bottom part of the same bib; and, adhesive means coupled to the inside surface of said outer layer on said free flap of said outer layer, said adhesive means covered by the free flap of said inner layer of the upper adjacent bib.

16. A strip of bibs, each of which can cover at least a part of the clothing worn by a person for protecting said person, comprising:

a plurality of bibs, each of which is substantially non-transmissive of a liquid spilled thereon for protecting the underlying clothing of a person when one of said bibs is worn over such clothing, said bibs being arranged in the form of an elongated strip with a portion of one end of each bib, except the first bib in said srip, overlapping a portion of the opposite end of each adjacent bib, said end portion of each bib having an adhesive covering thereon for adhesively securing said one end portion of each bib to said opposite end portion of each adjacent bib, said adhesive being securely attached to said one end portion of each bib and removably attached to said opposite end portion of each adjacent bib such that when each bib is separated from its adjacent bibs by peeling said one end portion thereof from said opposite end portion of its adjacent bib, said adhesive will remain on such one end portion so that it can be reused to adhere said bib to a person.

17. The strip of bibs of claim 16 wherein the adhesive on each bib is arranged in two separated portions of said one end portion of each bib, said one end portion having a recess between said two separated portions of adhesive for allowing said bib to fit around a person's neck.

18. The strip of bibs of claim 16 wherein each bib comprises two panels, said panels being offset from each other so that one end portion of one panel is free from the other panel and has said adhesive on the side thereon facing said other panel so as to constitute said one end portion of each bib, and so that one end portion of the other panel is free from said one panel so as to constitute said opposite end portion of each bib.

19. The strip of bibs of claim 18 wherein each of said first panels are detachably attached, edge to edge, except for the end panels in said strip.

* * * * *